US009669976B2

(12) United States Patent
Kastanek et al.

(10) Patent No.: US 9,669,976 B2
(45) Date of Patent: Jun. 6, 2017

(54) CONTAINER CLIP FOR ENGAGING AT LEAST ONE CONTAINER

(71) Applicant: Graphic Packaging International, Inc., Atlanta, GA (US)

(72) Inventors: Raymond S. Kastanek, Kennesaw, GA (US); James C. Fogle, Marietta, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 14/680,357

(22) Filed: Apr. 7, 2015

(65) Prior Publication Data

US 2015/0291329 A1 Oct. 15, 2015

Related U.S. Application Data

(60) Provisional application No. 61/995,477, filed on Apr. 11, 2014.

(51) Int. Cl.
*B65D 71/42* (2006.01)
*B65D 71/46* (2006.01)

(52) U.S. Cl.
CPC ..... *B65D 71/42* (2013.01); *B65D 71/46* (2013.01)

(58) Field of Classification Search
CPC ..... B65D 71/40; B65D 71/42; B65D 77/04; B65D 77/042; B65D 2571/0066; B65D 2571/00716; B65D 71/18; B65D 71/46
USPC ..... 206/145–147, 149, 434; 229/103.2; 493/162
See application file for complete search history.

(56) References Cited

U.S. PATENT DOCUMENTS

| | | | |
|---|---|---|---|
| 2,289,859 | A | 7/1942 | Arthur |
| 2,508,945 | A | 5/1950 | Heuer |
| 2,522,950 | A | 9/1950 | Keith |
| 2,566,804 | A | 9/1951 | LaFlamme et al. |

(Continued)

FOREIGN PATENT DOCUMENTS

| | | |
|---|---|---|
| EP | 0 013 838 | 8/1980 |
| EP | 0 346 693 | 12/1989 |

(Continued)

OTHER PUBLICATIONS

International Search Report and Written Opinion for PCT/US2015/024638 dated Jul. 8, 2015, 20 pages.

*Primary Examiner* — Bryon Gehman
(74) *Attorney, Agent, or Firm* — Womble Carlyle Sandridge & Rice, LLP

(57) ABSTRACT

A container clip for engaging at least one container having a top rim and a bottom rim. The container clip can comprise a plurality of panels extending at least partially around an interior of the container clip. The interior can be for receiving at least a portion of the at least one container. The plurality of panels can comprise a top panel and a bottom panel disposed generally opposite the top panel. At least one top locking flap can be foldably connected to the top panel for engaging the top rim of the at least one container for at least partially coupling the container clip to the at least one container. At least one bottom locking flap can be foldably connected to the bottom panel for engaging the bottom rim of the at least one container for at least partially coupling the container clip to the at least one container.

40 Claims, 11 Drawing Sheets

(56) References Cited

U.S. PATENT DOCUMENTS 2,571,833 A * 10/1951 Chidsey, Jr. ..... B65D 71/18 206/434
2,678,767 A * 5/1954 Toensmeier ..... B65D 71/18 206/149
2,798,603 A 7/1957 Grinspoon
2,798,655 A * 7/1957 Buttery ..... B65D 71/18 206/145
2,810,171 A 10/1957 Brooks et al.
2,815,855 A 12/1957 Fisher
2,817,473 A 12/1957 Foster
2,863,556 A 12/1958 Bedford, Jr.
2,888,135 A * 5/1959 Guyer ..... B65D 71/18 206/434
2,898,654 A 8/1959 Becker
2,909,820 A 10/1959 Ruth
2,950,041 A 8/1960 Stone
2,953,070 A * 9/1960 Dunning ..... B65B 11/105 206/434
2,974,851 A 3/1961 Struble
3,002,612 A 10/1961 Poupitch
3,022,888 A 2/1962 Brunsing
3,036,853 A 5/1962 Glazer
3,038,599 A 6/1962 Poupitch
D197,357 S 1/1964 DeSharzor, Jr.
3,125,278 A * 3/1964 Hughes ..... B65D 71/18 206/434
3,126,599 A 3/1964 Holland
3,137,109 A 6/1964 Rapata
3,143,210 A 8/1964 Heydon
3,167,832 A 2/1965 Holland
3,199,909 A 8/1965 Domenico et al.
3,202,447 A 8/1965 Whaley et al.
3,206,019 A 9/1965 Curry, Jr. et al.
3,292,843 A 12/1966 Chidsey, Jr. et al.
3,321,076 A 5/1967 Poupitch
3,347,364 A 10/1967 Gooding
3,347,366 A 10/1967 De Paul
3,357,551 A 12/1967 DeShazor, Jr.
3,370,700 A 2/1968 DeShazor, Jr.
3,381,881 A 5/1968 Ganz et al.
3,410,398 A 11/1968 Arneson
3,480,136 A 11/1969 Poupitch
3,528,697 A 9/1970 Wood
3,587,847 A 6/1971 Graser
3,601,439 A 8/1971 Poupitch
3,627,121 A 12/1971 Deasy
3,638,787 A * 2/1972 Phillips, Jr. ..... B65D 71/18 206/145
3,854,580 A 12/1974 Hennessey
3,897,873 A 8/1975 Graser
3,942,631 A 3/1976 Sutherland et al.
4,029,204 A 6/1977 Manizza
4,216,859 A 8/1980 Bader et al.
4,250,991 A 2/1981 Manizza et al.
4,273,273 A 6/1981 Zenri
4,304,329 A 12/1981 Graser
4,372,599 A 2/1983 Kiedaisch et al.
4,378,879 A 4/1983 Killy
4,382,505 A 5/1983 Sutherland et al.
4,552,265 A 11/1985 Bader
4,735,314 A 4/1988 Kadleck et al.
4,784,266 A 11/1988 Chaussadas
4,798,291 A 1/1989 Carver
4,875,585 A 10/1989 Kadleck et al.
4,890,738 A 1/1990 Carver
4,919,260 A 4/1990 Cunningham
5,000,313 A * 3/1991 Oliff ..... B65D 71/16 206/434
5,042,660 A 8/1991 Carver
5,058,735 A 10/1991 Bienaime
5,135,104 A 8/1992 Jorba
5,139,147 A 8/1992 Sutherland
5,188,225 A 2/1993 Jorba
5,188,413 A 2/1993 Nathan
5,201,412 A 4/1993 Schuster et al.
5,246,113 A 9/1993 Schuster
5,267,644 A 12/1993 Tsao
5,297,673 A 3/1994 Sutherland
5,310,050 A 5/1994 Sutherland
5,310,051 A 5/1994 Sutherland
5,318,178 A 6/1994 Davies et al.
5,323,895 A 6/1994 Sutherland et al.
5,328,024 A 7/1994 Sutherland
5,351,815 A 10/1994 Fogle et al.
5,351,816 A 10/1994 Sutherland et al.
5,351,817 A 10/1994 Sutherland
5,355,999 A 10/1994 Sutherland
5,360,104 A 11/1994 Sutherland
5,363,954 A * 11/1994 Dampier ..... B65D 71/42 206/144
1,527,399 A 2/1995 Davidson
5,390,784 A 2/1995 Sutherland
5,407,065 A 4/1995 Sutherland
5,415,278 A 5/1995 Sutherland
5,443,153 A 8/1995 Sutherland
5,445,262 A 8/1995 Sutherland
5,452,799 A 9/1995 Sutherland
5,503,267 A 4/1996 Sutherland
5,520,283 A 5/1996 Sutherland
5,524,756 A 6/1996 Sutherland
5,538,133 A 7/1996 Campbell et al.
5,542,536 A 8/1996 Sutherland
5,551,566 A 9/1996 Sutherland
5,553,705 A 9/1996 Bakx
5,593,027 A 1/1997 Sutherland
5,611,431 A 3/1997 Harris
5,706,936 A 1/1998 Bernstein
5,711,419 A 1/1998 Beales et al.
5,746,310 A 5/1998 Slomski
5,762,193 A 6/1998 Marco
5,791,463 A 8/1998 Negelen
5,816,391 A 10/1998 Harris
5,819,920 A 10/1998 Sutherland
D406,526 S 3/1999 Headrick
5,878,877 A 3/1999 Sutherland
5,899,515 A 5/1999 Burns
5,960,945 A 10/1999 Sutherland
6,039,181 A 3/2000 Whiteside
6,059,099 A 5/2000 Galbierz
6,315,111 B1 11/2001 Sutherland
6,394,272 B1 5/2002 Domansky
6,520,707 B1 2/2003 Headrick
6,779,655 B2 8/2004 Olsen
6,896,130 B2 5/2005 Theelen
7,011,209 B2 3/2006 Sutherland et al.
7,108,128 B2 9/2006 Borg
7,147,100 B1 12/2006 Borg
7,278,538 B2 10/2007 Chargueraud
7,690,507 B2 4/2010 Sutherland
7,958,605 B2 6/2011 Greco
8,387,784 B2 3/2013 Gonzalez et al.
8,443,968 B2 5/2013 DePaula
2002/0017476 A1 2/2002 Le Bras
2002/0195371 A1 12/2002 Brown
2003/0080004 A1 5/2003 Olsen et al.
2003/0213705 A1 11/2003 Woog
2004/0211695 A1 10/2004 Karlsson
2005/0127151 A1 6/2005 Johnson
2005/0199513 A1 9/2005 Bakx et al.
2005/0218013 A1 10/2005 Tabeshnekoo
2009/0101526 A1 4/2009 Sutherland et al.
2009/0127147 A1 5/2009 Sutherland
2013/0140196 A1 6/2013 Gonzalez Sanchez et al.

FOREIGN PATENT DOCUMENTS

EP 2 085 314 8/2009
GB 824383 A * 11/1959 ..... B65D 71/18
JP 07-257636 A 10/1995
JP 08-151070 A 6/1996
JP 2003-146359 5/2003
JP 2007-131328 A 5/2007
JP 2009-286445 A 12/2009

(56) References Cited

FOREIGN PATENT DOCUMENTS

| | | | | |
|---|---|---|---|---|
| WO | WO 94/22738 | | 10/1994 | |
| WO | WO 2005044549 | A2 * | 5/2005 | ..... B65D 71/18 |
| WO | WO 2013/026057 | A1 | 2/2013 | |
| WO | WO 2013026057 | A1 * | 2/2013 | ..... B65D 71/14 |

* cited by examiner

CONTAINER CLIP FOR ENGAGING AT LEAST ONE CONTAINER

CROSS REFERENCE TO RELATED APPLICATIONS

This application claims the benefit of U.S. Provisional Patent Application No. 61/995,477, filed Apr. 11, 2014.

INCORPORATION BY REFERENCE

The disclosure of U.S. Provisional Patent Application No. 61/995,477, which was filed on Apr. 11, 2014, is hereby incorporated by reference for all purposes as if presented herein in its entirety.

BACKGROUND OF THE DISCLOSURE

The present disclosure generally relates to can clips and/or cartons for holding and dispensing containers or other types of articles. More specifically, the present disclosure relates to a container clip for connecting two or more containers together and/or a carton with a divider to separate at least two layers of articles.

SUMMARY OF THE DISCLOSURE

In general, one aspect of the disclosure is directed to a container clip for engaging at least one container having a top rim and a bottom rim. The container clip can comprise a plurality of panels extending at least partially around an interior of the container clip. The interior can be for receiving at least a portion of the at least one container. The plurality of panels can comprise a top panel and a bottom panel disposed generally opposite the top panel. At least one top locking flap can be foldably connected to the top panel for engaging the top rim of the at least one container for at least partially coupling the container clip to the at least one container. At least one bottom locking flap can be foldably connected to the bottom panel for engaging the bottom rim of the at least one container for at least partially coupling the container clip to the at least one container.

In another aspect, the disclosure is generally directed to a container assembly comprising at least a first container and a second container. The first container can comprising a first rim and the second container comprising a second rim. The container assembly further can comprise a container clip engaging the first container and the second container. The container clip can comprise a top panel, a bottom panel disposed generally opposite the top panel, a first locking flap, and a second locking flap. Each of the first locking flap and the second locking flap can be foldably connected to one of the top panel and the bottom panel. The first locking flap can engage the first rim of the first container and the second locking flap can engage the second rim of the second container.

In another aspect, the disclosure is generally directed to a package comprising a carton and a container assembly. The carton can comprise a plurality of panels extending at least partially around an interior of the carton. The container assembly can be disposed at least partially in the interior of the carton. The container assembly can comprise at least a first container and a second container and a container clip engaging the first container and the second container.

In another aspect, the disclosure is generally directed to a clip blank for forming a container clip for engaging at least one container having a top rim and a bottom rim. The clip blank can comprise a plurality of panels comprising a top panel and a bottom panel disposed generally opposite the top panel. At least one top locking flap can be foldably connected to the top panel for engaging the top rim of the at least one container when the clip blank is formed into the container clip for at least partially coupling the container clip formed from the clip blank to the at least one container. At least one bottom locking flap can be foldably connected to the bottom panel for engaging the bottom rim of the at least one container when the clip blank is formed into the container clip for at least partially coupling the container clip formed from the clip blank to the at least one container.

In another aspect, the disclosure is generally directed to a method of forming a container assembly comprising obtaining a clip blank comprising a plurality of panels comprising a top panel and a bottom panel, at least one top locking flap foldably connected to the top panel, and at least one bottom locking flap foldably connected to the bottom panel. The method also can comprise forming a container clip from the clip blank by folding the plurality of panels relative to one another to form an interior of the container clip. The forming the container clip can comprise disposing the top panel and the bottom panel adjacent respective ends of at least one container having a top rim and a bottom rim. The method further can comprise engaging the at least one top locking flap with the top rim and engaging the at least one bottom locking flap with the bottom rim.

In another aspect, the disclosure is generally directed to a method of forming a container assembly comprising obtaining a clip blank comprising a top panel, a bottom panel, a first locking flap, and a second locking flap. Each of the first locking flap and the second locking flap can be foldably connected to one of the top panel and the bottom panel. The method also can comprise obtaining a first container comprising a first rim and a second container comprising a second rim, at least partially forming a container clip from the clip blank, and engaging the container clip with the first container and the second container. The engaging the container clip can comprise engaging the first locking flap with the first rim of the first container and engaging the second locking flap with the second rim of the second container.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to carriers, clips, constructs, sleeves, cartons, or the like, and packages for holding and displaying articles such as cans, cups, jars, bottles, etc. The containers can be used for packaging food and beverage products, for example. The articles can be made from materials suitable in composition for packaging the particular food or beverage item, and the materials include, but are not limited to, glass and the like; aluminum and/or other metals; plastics such as PET, LDPE, LLDPE, HDPE, PP, PS, PVC, EVOH, and Nylon; paperboard, composite paperboard, and the like, or any combination thereof.

Clips and/or cartons according to the present disclosure can accommodate articles of any shape. For the purpose of illustration and not for the purpose of limiting the scope of the disclosure, the following detailed description describes beverage containers (e.g., aluminum cans) as associated with the clip embodiments and/or as disposed within the carton embodiments. In this specification, the terms "inner," "interior," "outer," "exterior," "lower," "bottom," "upper," and "top" indicate orientations determined in relation to fully erected and upright clips and cartons.

Figure 1:
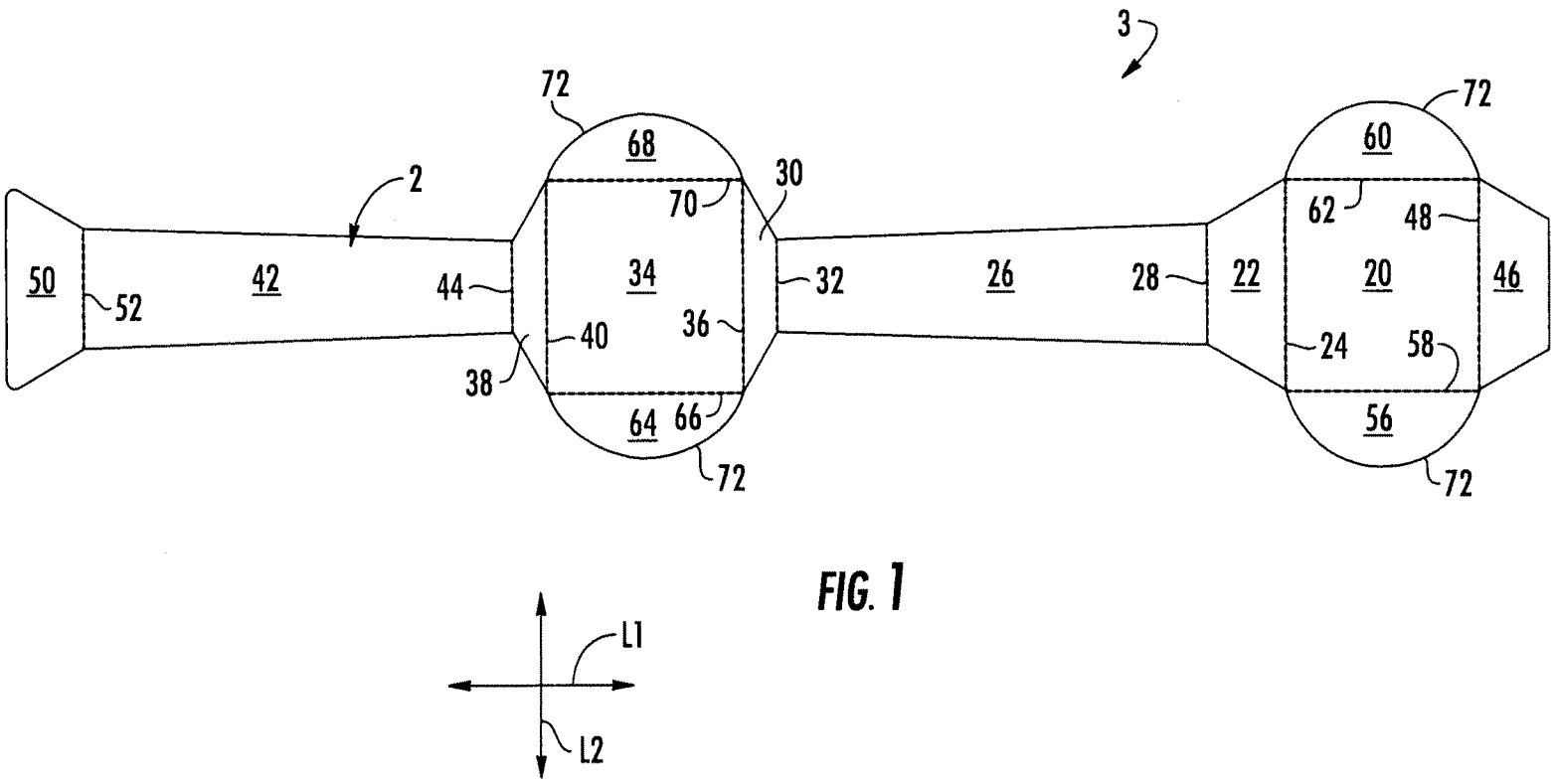
FIGS. 1 and 2 are plan views of a clip blank used to form a container clip according to an exemplary embodiment of the disclosure.

FIG. 1 is a plan view of an interior surface 2 of a clip blank 3 used to form a container clip 5 (FIGS. 4-5C) according to an exemplary embodiment of the disclosure. The clip 5 can be used to connect two or more containers C together (e.g., the clip can engage two adjacent containers C) so that multiple clips 5 can engage multiple containers C in series to form an assembly (e.g., a string or chain or spine of containers and clips; FIGS. 3A-5C). In the illustrated embodiment, the containers C are illustrated as aluminum cans (e.g., beer or soda cans) having a top portion T with an upper rim R1 (FIG. 3A) and bottom portion B with a domed portion D and a lower rim R2 (FIG. 3B); however, other containers may be engaged by the clips 5 without departing from the disclosure.

The clip blank 3 has a longitudinal axis L and a lateral axis L2. In the illustrated embodiment, the clip blank 3 includes a top panel 20 foldably connected to a first side panel 26 along a first transverse fold line 24, a bottom panel 34 foldably connected to the first side panel 30 along a second transverse fold line 36, and a second side panel 42 foldably connected to the bottom panel 34 along a third transverse fold line 40. A first attachment flap 46 can be foldably connected to the top panel 20 along a fourth transverse fold line 48, and a second attachment flap 50 can be foldably connected to the second side panel 42 along an fifth transverse fold line 52.

In one embodiment, the first side panel can include an upper portion forming a first upper bevel panel 22 defined by the first transverse fold line 24 and a sixth transverse fold line 28 and a lower portion forming a first lower bevel panel 30 defined by the second transverse fold line 36 and a seventh transverse fold line 32. The second side panel 42 can include a lower portion forming a second lower bevel panel 38 defined by the third transverse fold line 40 and an eighth lateral fold line 44. In the illustrated embodiment, the attachment flaps 46, 50 can be overlapped and secured (e.g., glued) to one another to form a second upper bevel panel 54 (FIG. 3A) when the clip 5 is formed from the clip blank 3.

As shown in FIG. 1, the edges of the bevel panels 22, 54, 30, 38 can be oblique so that the bevel panels taper away from the respective top panel 20 and bottom panel 34. Additionally, the side panels 26, 42 can taper from the upper bevel panels 22, 54 to the lower bevel panels 30, 38. Any of the top and bottom panels 20, 34, the first and second side panels 26, 42, and the upper and lower bevel panels 22, 54, 30, 38 can be otherwise shaped, arranged, configured, or omitted without departing from the disclosure. For example, any of the side panels 26, 42 and/or bevel panels 22, 30, 38, 54 could have generally orthogonal edges. In another example, one or both of the attachment flaps 46, 50 could be connected to different panels of the blank 3, or the blank 3 can alternatively include two top panels cooperating to form a top of the clip 5 or two bottom panels cooperating to form a bottom of the clip.

The top panel 20 is foldably connected to a first top locking flap 56 along a first longitudinal fold line 58 and a second top locking flap 60 along a second longitudinal fold line 62. Similarly, the bottom panel 34 is foldably connected to a first bottom locking flap 64 along a third longitudinal fold line 66 and a second bottom locking flap 68 along a fourth longitudinal fold line 70. In the illustrated embodiment, each of the locking flaps 56, 60, 64, 68 can have a curved (e.g., semicircular or any other suitable shape) edge 72 for engaging a curved interior surface S (FIGS. 3A-3C and 4) of a respective upper rim R1 or lower rim R2 of a respective container C. In one embodiment, the curved edges 72 can allow the container C to rotate with respect to the clips 5. For example, the curved edges 72 can have a corresponding and/or complementary shape to the shape of the curved interior surface S of the rims R1, R2 so that the rims R1, R2 can slide past the locking flaps 56, 60, 64, 68 as the containers C1, C2 rotate. In the illustrated embodiment, the curved interior surfaces S are generally annular surfaces and the curved edges 72 are, correspondingly, generally semicircular. The locking flaps 56, 60, 64, 68 could be omitted or could be otherwise shaped, arranged, positioned, and/or configured without departing from the disclosure.

Figure 2:
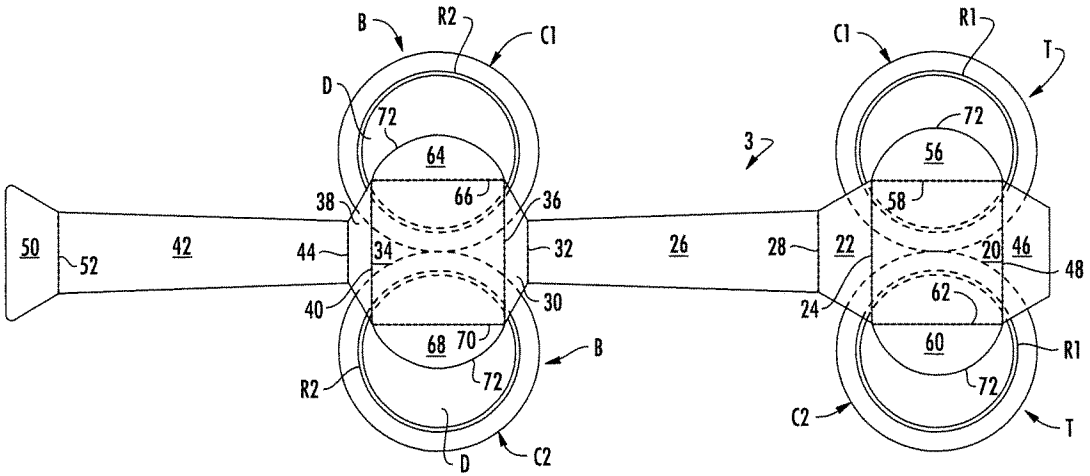
Figure 3A:
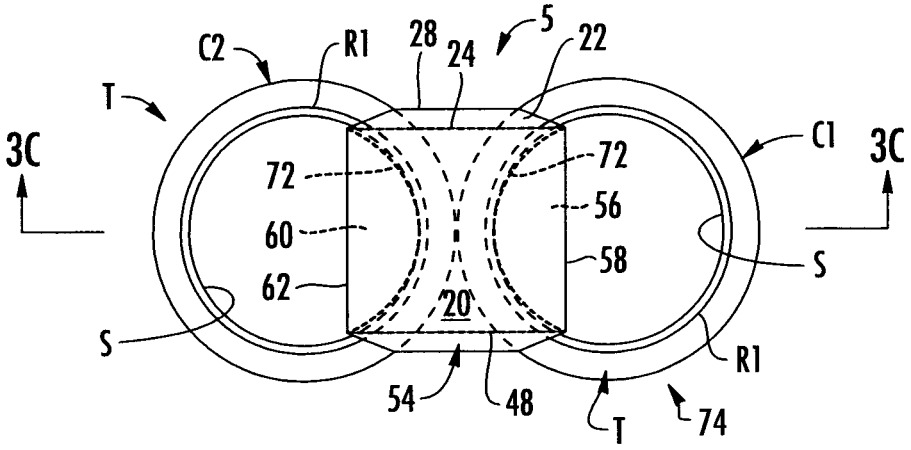
FIG. 3A is a top view showing the container clip engaging the tops of two containers according to the exemplary embodiment of the disclosure.
Figure 3B:
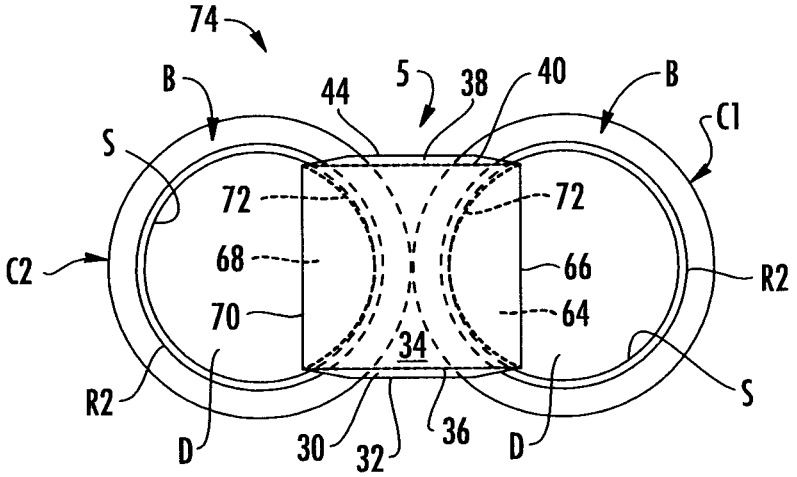
FIG. 3B is a bottom view showing the container clip engaging the bottoms of two containers according to the exemplary embodiment of the disclosure.
Figure 3C:
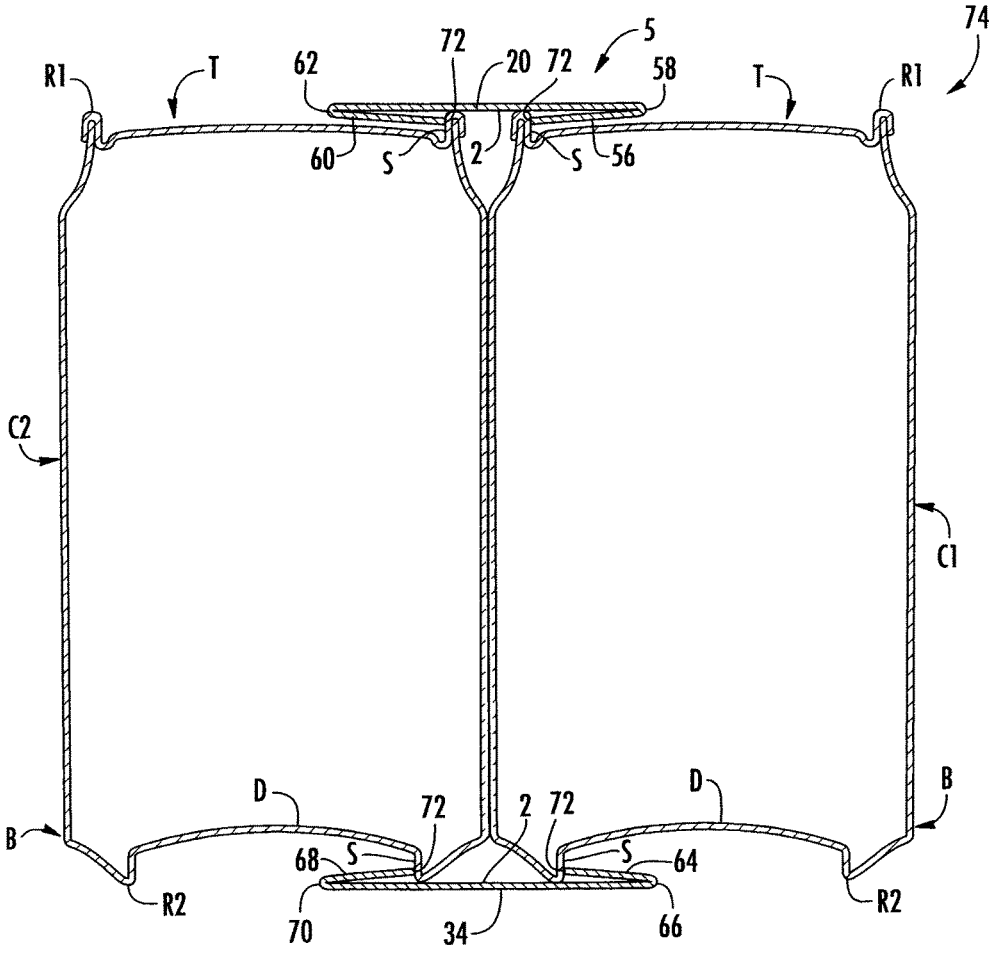
FIG. 3C is a cross-sectional view of the container clip and containers taken at line 3C-3C in FIG. 3A.
Figure 4:
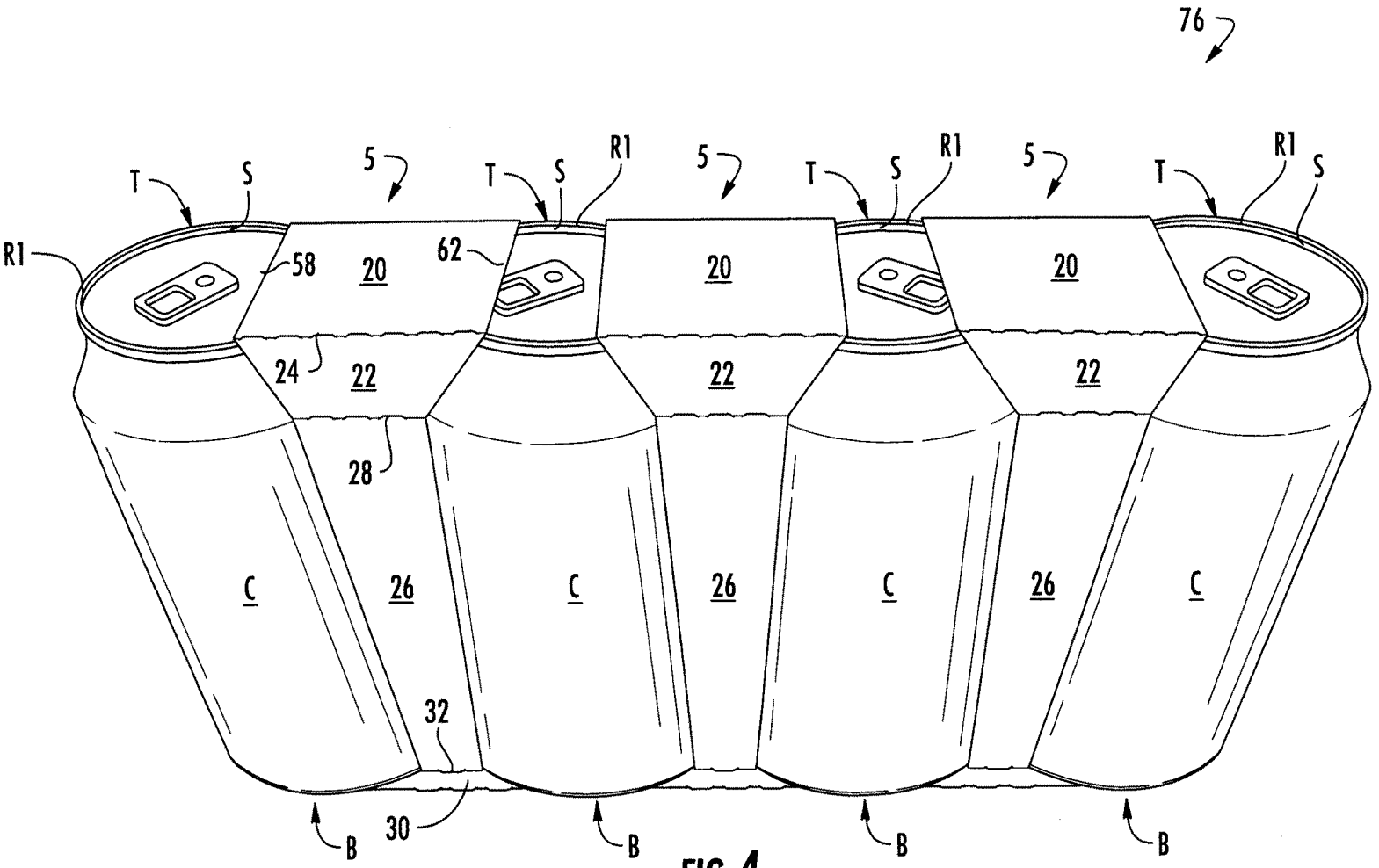
FIGS. 4-5C are perspective views showing an assembly including several container clips engaging several containers according to the exemplary embodiment of the disclosure.

In one embodiment, the clip 5 can be formed from the clip blank 3 as shown in FIGS. 2-4. FIG. 2 illustrates the alignment of the top panel 20 with the top portions T of two containers C1, C2 and the bottom panel 34 with the bottom portions B of the two containers C1, C2. When the clip 5 is formed, however, the bottom panel 34 is disposed adjacent the bottom portions B, the side panels 26, 42 are folded along the sides of the containers C1, C2, and then the top panel 20 is disposed adjacent the top portions T. Alternatively, the top panel 20 is disposed adjacent the top portions T, the first side panel 26 is folded against the sides of the containers, the bottom panel 34 is disposed adjacent the bottom portions B, and the second side panel 42 is folded against the sides of the containers.

In one embodiment, as shown in FIGS. 3A-3C, two containers C1, C2 can be disposed adjacent one another (e.g., so that the sides of the containers contact one another) and the top panel 20 can be aligned with the top portions T of the containers C1, C2. As shown in FIGS. 3A and 3C, the top locking flaps 56, 60 are folded along the respective longitudinal fold lines 58, 62 to be adjacent and/or in face-to-face contact with an interior surface 2 of the top panel 20, and the top panel 20 and the top locking flaps 56, 60 are disposed against the top portions T of the containers so that the top locking flap 56 is disposed within the top rim R1 of the container C1 and the locking flap 60 is disposed within the top rim R1 of the container C2. As shown in FIGS. 3A and 3C, the curved edges 72 of the top locking flaps 56, 60 can engage the curved interior surface S of the upper rim R1 of the respective containers C1, C2. The clip blank 3 can be folded along the transverse fold lines 24, 28, 32, 36 so that the bevel panels 22, 30 and the first side panel 26 extend along the sides of the containers C1, C2 and so that one edge of the bevel panels 22, 30 and the first side panel 26 engages the container C1, and the opposing edge of the bevel panels 22, 30 and the first side panel 26 engages the container C2.

In the illustrated embodiment, the bottom panel 34 is aligned with the bottom portions B of the containers C1, C2 and the bottom locking flaps 64, 68 are folded along the respective longitudinal fold lines 66, 70 so that the bottom locking flaps 64, 68 are adjacent the interior surface 2 of the bottom panel 34. As the bottom panel 34 folds along the fold line 36, the bottom panel 34 and the bottom locking flaps 64, 68 are disposed against the bottom portions B of the containers C1, C2 so that the bottom locking flaps 64, 68 are disposed in the domed portions D within the bottom rims R2 of the respective containers C1, C2 (FIGS. 3B and 3C). As shown in FIGS. 3B and 3C, the curved edges 72 of the bottom locking flaps 64, 68 can engage the curved interior surface S of the lower rims R2 of the respective containers C1, C2. The clip blank 3 can be folded along the transverse fold lines 40, 44, 52, 48, so that the bevel panel 38 and the second side panel 42 extend along the sides of the containers and so that one edge of the bevel panel 38 and the second side panel 42 engages the container C1, and the opposing edge of the bevel panel 38 and the second side panel 42 engages the container C2. Additionally, the attachment flaps 46, 50 can be overlapped and secured (e.g., glued) together to form the second upper bevel panel 54 (FIG. 3A). The clip 5 could be otherwise assembled without departing from the disclosure. For example, the bottom panel 34 could be aligned with the bottom portions B of the containers C1, C2 first, and the clip blank 3 can be wrapped around the containers.

As shown in FIGS. 3A-3C, an assembly 74 is formed including the clip 5 and the two containers C1, C2 retained in the interior of the clip 5 defined by at least the top and bottom panels 20, 34 and the side panels 26, 42. In the illustrated embodiment, the clip 5 can couple the two containers C1, C2 together so that the entire assembly 74 can be supported or lifted by the clip 5 and/or one or both of the two containers C1, C2. For example, the side panels 26, 42 help retain the top panel 20 and the bottom panel 34 against the respective top portions T and bottom portions B of the containers C1, C2, and the top locking flaps 56, 60 and the bottom locking flaps 64, 68 engage the respective rims R1, R2 of the containers C1, C2 to help prevent the containers C1, C2 from being pulled apart from one another and removed from the interior of the clip 5. Additionally, each of the containers C1, C2 in the assembly 74 can rotate with respect to the clip 5 and/or the other container. For example, as the container C1 rotates, the curved interior surfaces S of the rims R1, R2 can slidingly engage the curved edges 72 of the respective locking flaps 56, 64. Accordingly, the containers C1, C2 have a slidable engagement with the curved edges 72 and are free to rotate with respect to the clip 5 while the containers remained coupled by the clip 5.

Figure 5A:
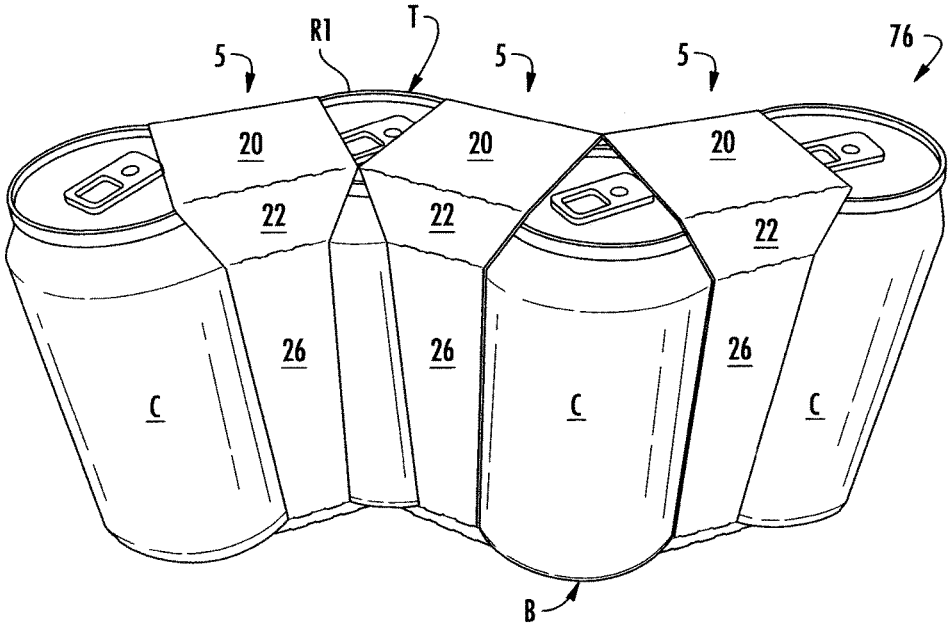
Figure 5B:
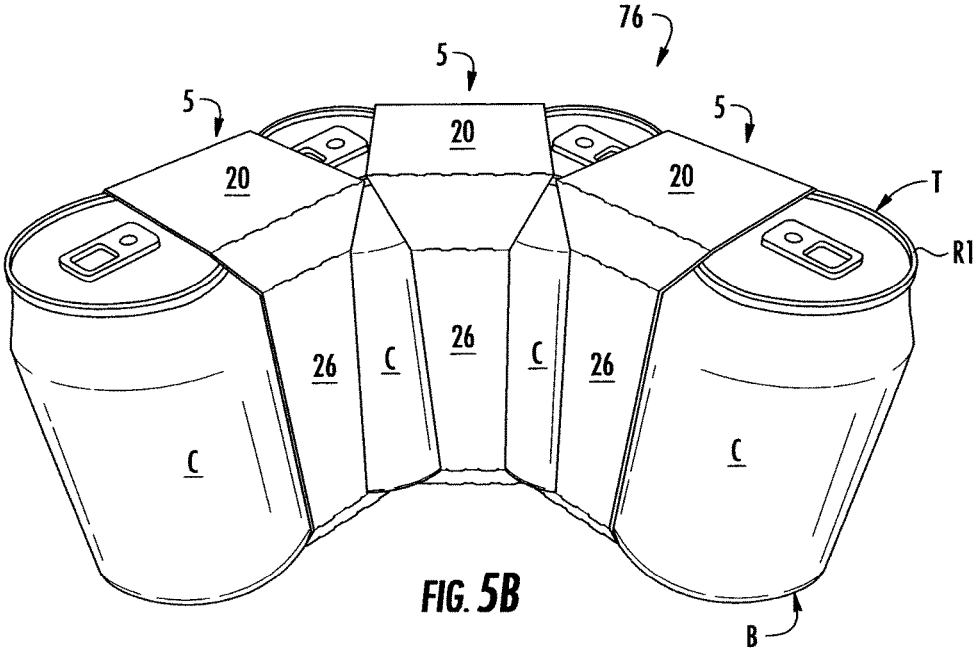
Figure 5C:
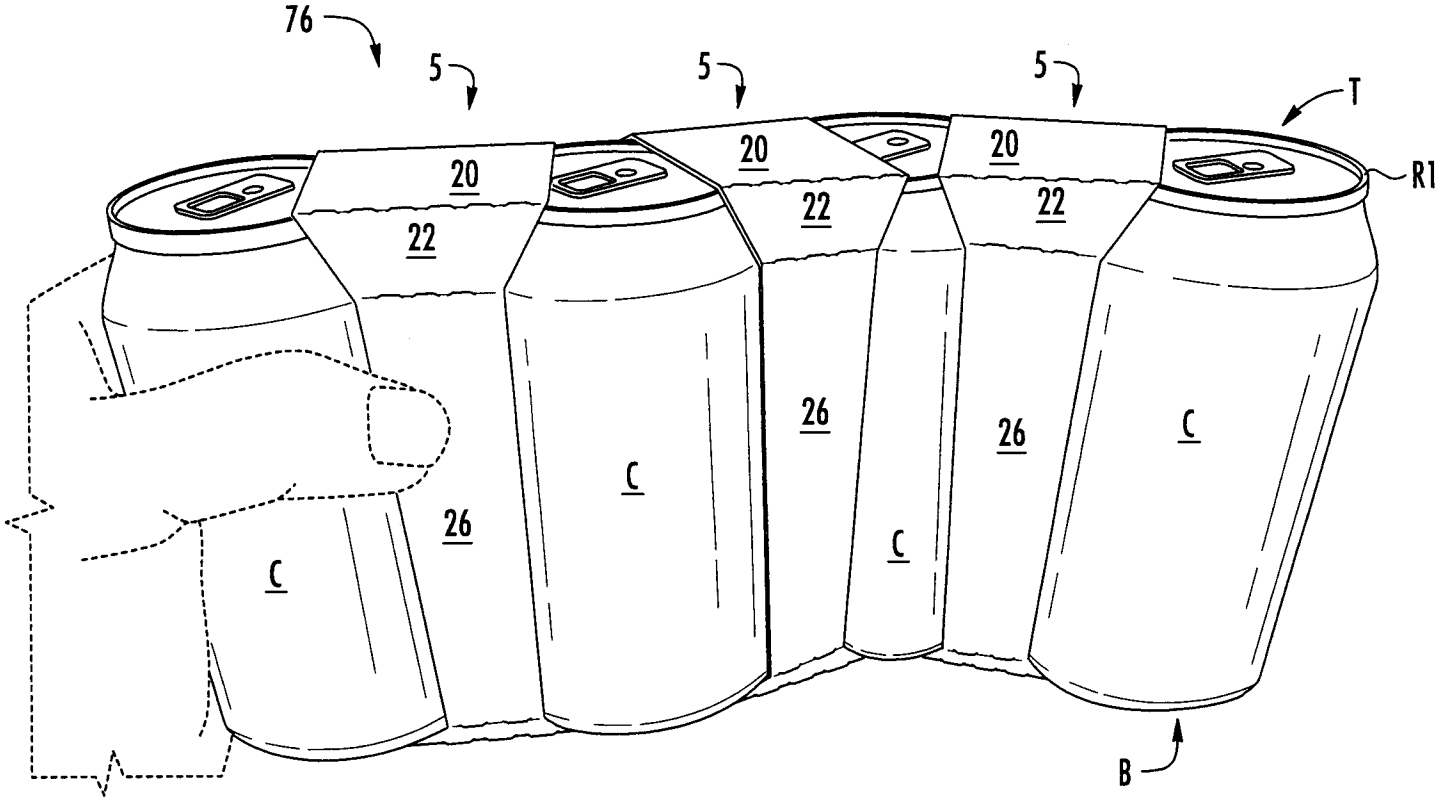

As shown in FIG. 4, a plurality of clips 5 can connect several containers C in series. Three clips 5 connect four containers C in the assembly 76 shown in FIG. 4; however, any suitable number of clips can be used to connect any suitable number of containers C in a series. In one exemplary embodiment, the number of containers in a series can be one more than the number of clips in the series. In another exemplary embodiment, the assembly could include an equal number of containers and clips or one more clip than the number of containers (e.g., one clip could be engaged with only one container at one or both ends of the assembly). Since each of the containers C in the assembly 76 can rotate with respect to the other containers and the clips 5, the assembly 76 can form a generally straight line (FIG. 4), or could include one or more turns to form an arc (FIG. 5B) or wave-like shape (FIGS. 5A and 5C). As shown in FIG. 5C, the assembly 76 could be lifted and/or carried, for example, by holding one or more of the containers C (e.g., a container on an end of the assembly 76). The assembly could also be held at one or more of the clips 5. In one embodiment, a suitably long series of clips 5 and containers C could be coiled or formed into other shapes. For example, a series of clips and containers could form a closed circle (in which the number of containers and clips would be equal). The clips 5 and containers C could be otherwise assembled without departing from the disclosure.

In one embodiment, one of the containers C can be removed from the assembly 76 (or the assembly 76 could be split into couplings of two or more containers C) by pulling a container C away from one of the clips 5. For example, the container C could be pivoted and/or twisted to disengage the top locking flap 56 or the bottom locking flap 64 from the respective rim R1, R2, and the container could be pulled away from the clip 5. This clip 5 could remain engaged with the other container C by the locking flaps 60, 68 in this example. Alternatively, the other container could be removed from the clip. In one embodiment, the clip 5 can make a sound (e.g., a clicking sound or any other suitable sound) when a container C is removed (e.g., by interaction between the locking flaps 56, 64, 60, 68 and the rims R1, R2). The assembly 76 (or the assembly 74) could be otherwise broken up, or one or more containers C could be otherwise removed from an assembly without departing from the disclosure.

Figure 8:
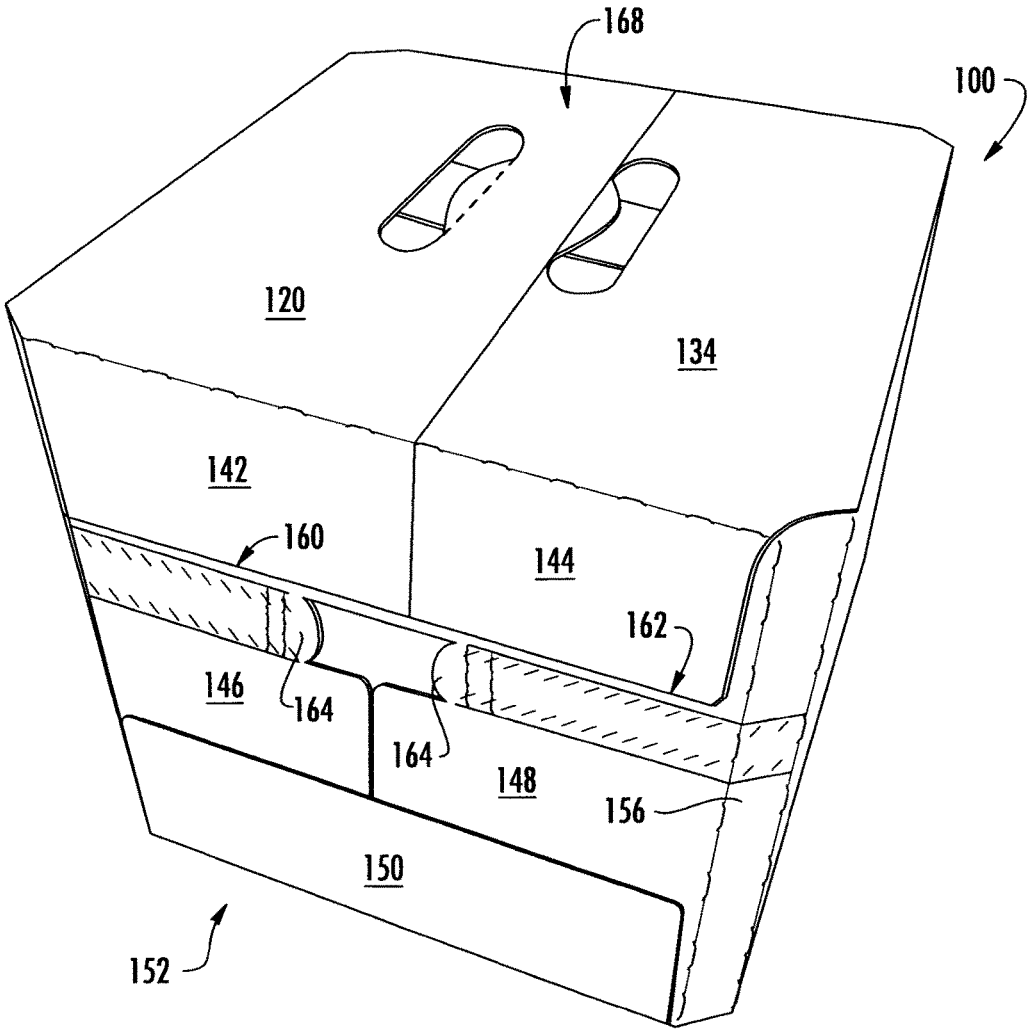
FIG. 8 is a perspective view showing the assembled carton according to the exemplary embodiment of the disclosure.
Figure 9:
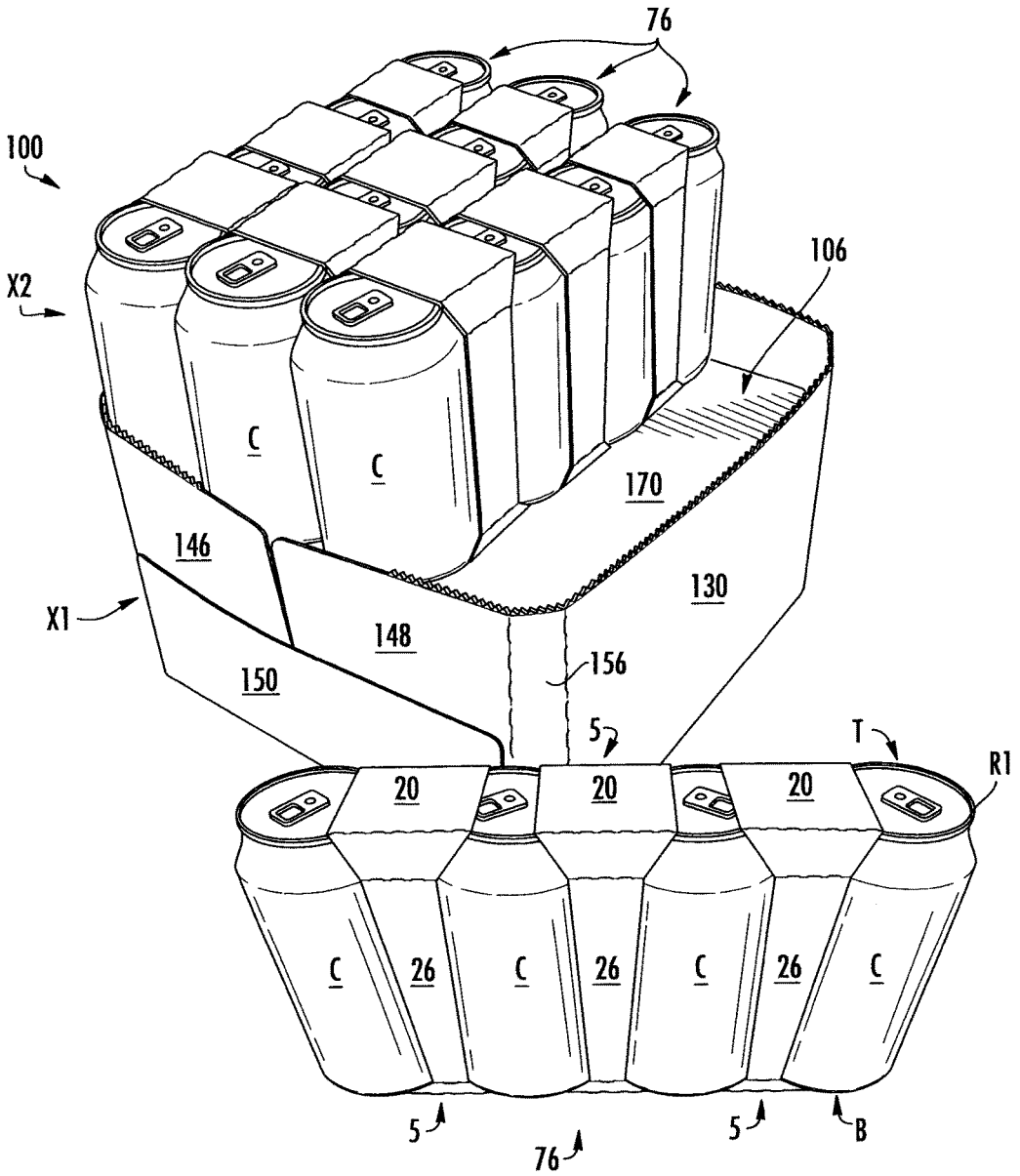
FIG. 9 is a perspective view showing the carton, the divider, and several container clips engaging several containers with a dispenser portion removed from the carton according to the exemplary embodiment of the disclosure.

In one embodiment, a plurality of the assemblies 76, and/or other assemblies with different numbers of containers C and/or clips 5 than the assembly 76, can be contained in any suitable outer carton. In one exemplary embodiment, a number of assemblies 76 can be contained in a carton 100 (FIGS. 8 and 9).

Figure 6:
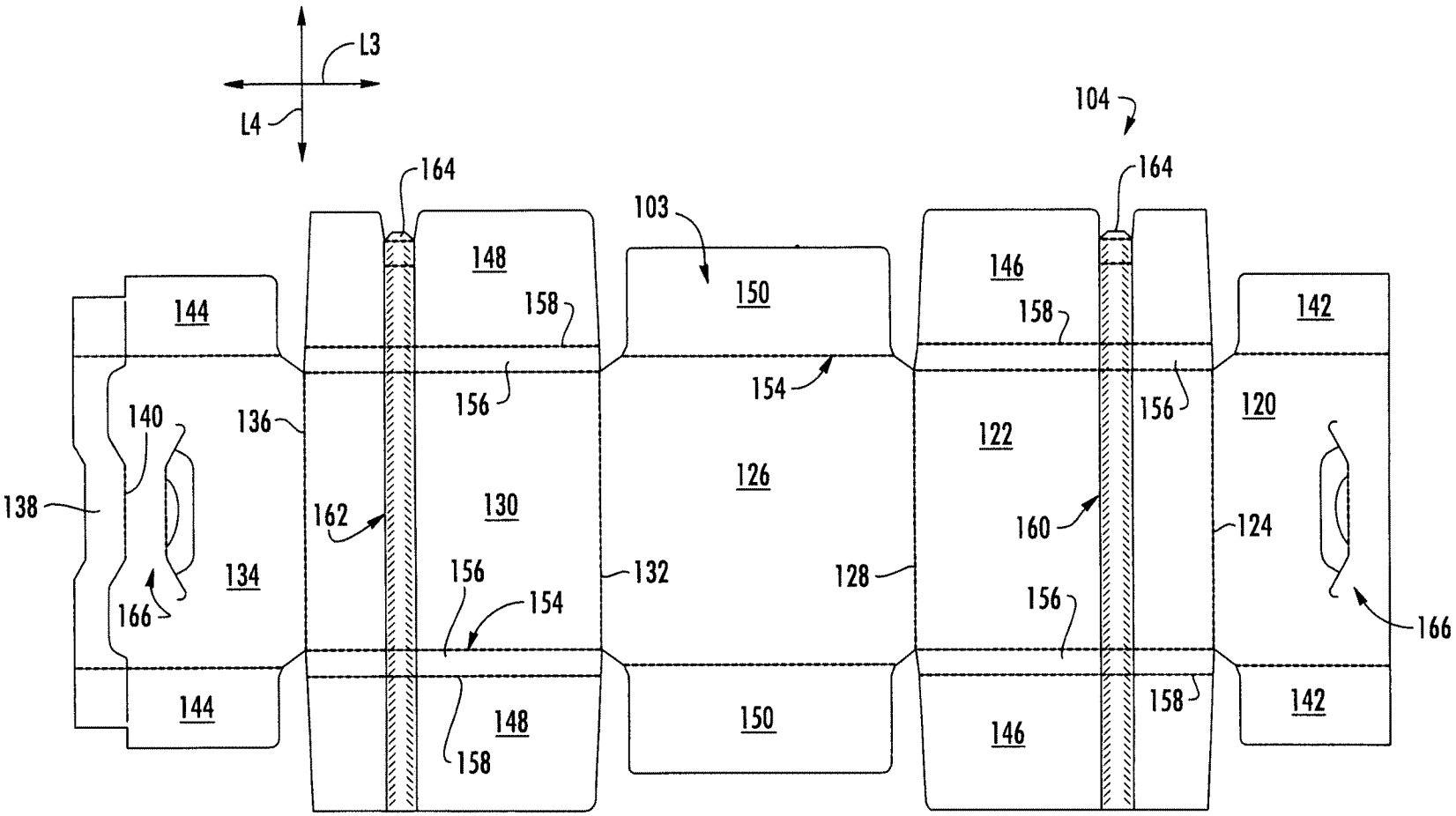
FIG. 6 is a plan view of a carton blank used to form a carton according to an exemplary embodiment of the disclosure.
Figure 7:
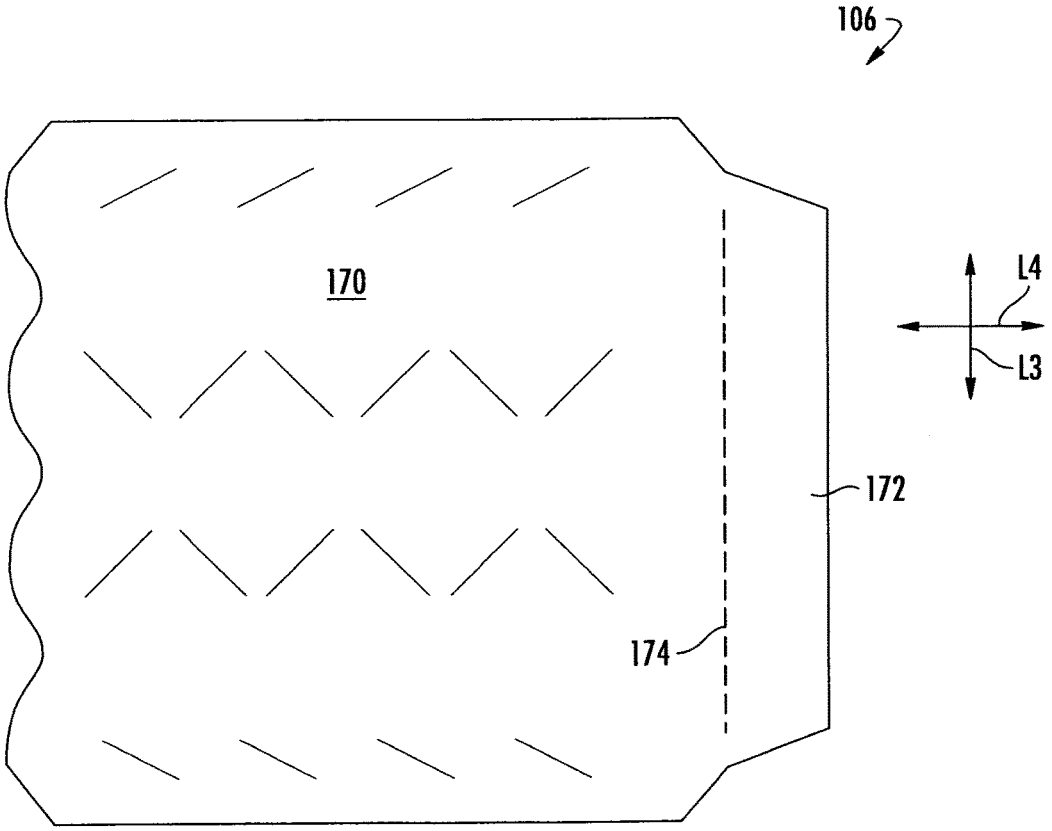
FIG. 7 is a plan view of a divider used in the carton according to the exemplary embodiment of the disclosure.

FIG. 6 is a plan view of an exterior surface 103 of a carton blank 104 used to form the carton 100 (FIG. 8) according to an exemplary embodiment of the disclosure. The carton 100 can be used to house a plurality of articles such as the containers C (FIG. 9) arranged in at least two layers in the carton. As described above, the containers C can be coupled by the clips 5 to form the assemblies 76. In the illustrated embodiment, the layers of containers C are separated by a divider, generally indicated at 106 (FIGS. 7 and 9). Alternatively, the divider could be omitted. As shown in FIG. 9, the assemblies 76 can be arranged in a lower layer X1 and an upper layer X2 with each of the lower and upper layers X1, X2 comprising sixteen containers arranged in four rows (assemblies 76), four containers per row. This arrangement is generally referred to as a 4×4×2 arrangement. It is understood that the containers C may be arranged in more than two layers and that each layer may have more or less than sixteen containers without departing from the scope of this disclosure.

The carton blank 104 has a longitudinal axis L3 and a lateral axis L4. In the illustrated embodiment, the carton blank 104 comprises a first top panel 120 foldably connected to a first side panel 122 at a first transverse fold line 124, a bottom panel 126 foldably connected to the first side panel 122 at a second transverse fold line 128, a second side panel 130 foldably connected to the bottom panel 126 at a third transverse fold line 132, and a second top panel 134 foldably connected to the second side panel 130 at a fourth transverse fold line 136. A handle reinforcing flap 138 can be foldably connected to the second top panel 134 along a lateral fold line 140. The top panels 120, 134 can be overlapped and secured (e.g., glued) together to form a top wall (FIG. 8) when the carton 100 is formed. The carton blank 104 could be otherwise shaped, arranged, positioned, and/or configured without departing from the disclosure. For example, the handle reinforcing flap 138 could be omitted, or the carton blank could include one top panel and an attachment flap instead of two top panels.

The top panel 120 is foldably connected to first top end flaps 142, and the second top panel 134 is foldably connected to second top end flaps 144. The first side panel 122 is foldably connected to first side end flaps 146, and the second side panel 130 is foldably connected to second side end flaps 148. The bottom panel 126 is foldably connected to bottom end flaps 150. When the carton 100 is erected, the end flaps 142, 144, 146, 148, and 150 close respective ends 152 of the carton 100. In accordance with an alternative embodiment of the present disclosure, different flap arrangements can be used for closing the ends of the carton.

The end flaps 142, 144, 146, 148, and 150 may extend along respective marginal areas of the carton blank 104, and may be foldably connected at respective longitudinal fold lines 154 that extend along the length of the carton blank 104. The longitudinal fold lines 154 may be, for example, substantially straight, or offset at one or more locations to account for blank thickness or for other factors. The side end flaps 146, 148 can each include a corner portion 156 defined by the respective longitudinal fold line 154 and a respective longitudinal fold line 158. The corner portions 156 can help the carton 100 conform to the shapes of the containers C at the corners of the carton.

The carton blank 104 has opening features that include a first tear strip 160 extending in the lateral direction L2 in the first side end flaps 146 and the first side panel 122 and a second tear strip 162 extending in the lateral direction L2 in the second side end flaps 148 and the second side panel 130. The tear strips 160, 162 can include one or more opening tabs 164. The carton blank 104 also can include handle features 166 in the top panels 120, 134 and the handle reinforcing flap 138 for forming a handle 168 in the carton 100 (FIG. 8). The side end flaps 146, 148, the tear strips 160, 162, and/or the handle features 166 could be otherwise shaped, arranged, and/or configured without departing from the disclosure.

As shown in FIG. 7, the divider 106 of the illustrated embodiment has a longitudinal axis L3 and a lateral axis L4. As illustrated in FIG. 7, the L3 direction will be referred to as the longitudinal direction and the L4 direction will be referred to as the transverse or lateral direction for the divider 106 in order to comport with the convention established for the carton blank 104 (FIG. 6). Accordingly, a longitudinal line in the divider 106 will be generally aligned with and/or parallel to a longitudinal line (e.g., the longitudinal fold line 154) in the carton blank 104. The divider 106 has a main panel 170 for positioning between the layers X1, X2 of containers C when the containers are loaded into the carton 100 (FIG. 9) and an end flap 172. The main panel 170 may be sized to generally correspond with the size of the bottom panel 126 of the carton blank 104. The end flap 172 can be foldably connected to the main panel 170 along a fold line 174.

In one embodiment, the carton 100 may be erected from the carton blank 104 by folding the carton blank 104 along the transverse fold lines 140, 124, 128, 132, 136, gluing the handle reinforcing flap 138 in face-to-face contact with the interior surface of the second top panel 134, and gluing a portion of the second top panel 134 in face-to-face contact with the interior surface of the first top panel 120 to form the top wall and an open-ended sleeve (not shown). The forming the top wall can also include forming the handle 168 (FIG. 8). The open-ended sleeve could be formed by other folding, positioning, and/or gluing steps without departing from the disclosure.

As shown in FIG. 9, the assemblies 76 of containers C can be configured in a stacked arrangement with a first (lower) layer of containers X1 and a second (upper) layer of containers X2 located above the first layer of containers X1. The divider 106 can be positioned between the two layers of containers prior to placing the containers in the open-ended sleeve (e.g., through an open end of the sleeve). Alternatively, the lower layer X1 can be loaded into the sleeve, the divider 106 could be positioned on the lower layer X1, and the top layer X2 could be loaded into the sleeve and positioned on the divider 106. In another alternative, the divider could be omitted. After loading the containers C and the divider 106, the ends 152 can be closed by overlapping and gluing the end flaps 142, 144, 146, 148, 150 at each end. The end flap 172 of the divider 106 can be folded downwardly or upwardly with respect to the main panel 170 against the containers at one end of the respective lower layer X1 or upper layer X2, and, when the end 152 of the carton is closed, the end flap 172 can be disposed between the containers C and the closed end 152. In one embodiment, the carton 100 and the assemblies 76, including the containers C and the clips 5, loaded into the carton 100 form a package 180. The carton 100 and/or the package 180 could be formed by other folding, positioning, loading, and/or gluing steps without departing from the disclosure.

As shown in FIG. 9, the carton 100 can be opened by activating the opening features or tear strips 160, 162 to separate the carton 100 into an upper portion (not shown) and a lower portion. Removal of the upper portion of the carton 100 provides access to the containers C in the upper layer X2 that are located above the divider 106. Each of the assemblies 76 can be removed from the opened carton 100 shown in FIG. 9. FIG. 9 shows one assembly 76 removed. Additionally, one or more containers C can be separated from each assembly 76 as described above. The containers C and the assemblies 76 in the bottom row X1 can be accessed after removing the assemblies 76 in the top row X2 and removing the divider 106. Alternatively, the containers C and/or the divider 106 could be otherwise removed from the carton 100. In one embodiment, the assemblies 76 can help with quickly removing a number of containers C from the carton 100. For example, a user could grasp an assembly 76 in each hand to remove eight containers C from the carton 100 and place those containers/assemblies into a cooler or a refrigerator in a single motion. Removing the containers C individually (e.g., if clips 5 were omitted) generally would take more time and more effort. The package 180 and/or carton 100 could have other features or the features shown could be otherwise shaped, arranged, positioned, and/or configured without departing from the disclosure.

The present disclosure can be used in cartons that include various features, including additional opening features that provide easy access to the articles, and tilt features that position the articles at the front or rear end of the carton.

In general, the blanks of the present disclosure may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A container clip and at least one container, each container of the at least one container having a diameter, a top rim, and a bottom rim, the container clip comprising:

a plurality of panels extending at least partially around an interior of the container clip, the interior being for receiving at least a portion of the at least one container, the plurality of panels comprising a top panel, a bottom panel disposed generally opposite the top panel, a first side panel extending at least partially between the top panel and the bottom panel, and a second side panel extending at least partially between the top panel and the bottom panel, wherein the first side panel and the second side panel are spaced apart from one another by a distance that is less than the diameter of each container of the at least one container;

at least one top locking flap foldably connected to the top panel for engaging the top rim of the at least one container for at least partially coupling the container clip to the at least one container; and at least one bottom locking flap foldably connected to the bottom panel for engaging the bottom rim of the at least one container for at least partially coupling the container clip to the at least one container;

wherein the top panel has a top width extending away from the at least one top locking flap, the bottom panel has a bottom width extending away from the at least one bottom locking flap, the first side panel has a side width extending generally parallel to at least one of the top width and the bottom width, and the side width is less than at least one of the top width and the bottom width.

2. The container clip and at least one container of claim 1, wherein each of the at least one top locking flap and the at least one bottom locking flap comprises a curved edge for engaging an interior surface of the respective top rim and bottom rim.

3. The container clip and at least one container of claim 1, wherein at least one of the at least one top locking flap and the at least one bottom locking flap is disposed at least partially in face-to-face contact with a respective inner surface of the respective top panel and bottom panel.

4. The container clip and at least one container of claim 1, wherein the plurality of panels further comprises at least one bevel panel foldably connected to at least one of the top panel and the bottom panel along a first fold line and to the first side panel along a second fold line, and the top width, the bottom width, and the side width are generally parallel to the first fold line.

5. The container clip and at least one container of claim 4, wherein the at least one bevel panel comprises oblique edges.

6. The container clip and at least one container of claim 1, wherein the plurality of panels further comprises a top bevel panel foldably connected to each of the top panel and the first side panel and a bottom bevel panel foldably connected to each of the bottom panel and the first side panel.

7. The container clip and at least one container of claim 1, wherein:

the at least one container comprises a first container and a second container, the interior of the container clip being for receiving at least a portion of each of the first container and the second container;

the at least one top locking flap comprises a first top locking flap and a second top locking flap, the top width extending from the first top locking flap to the second top locking flap; and the first top locking flap is for engaging the top rim of the first container, and the second top locking flap is for engaging the top rim of the second container.

8. The container clip and at least one container of claim 7, wherein the at least one bottom locking flap comprises a first bottom locking flap for engaging the bottom rim of the first container and a second bottom locking flap for engaging the bottom rim of the second container, the bottom width extending from the first bottom locking flap to the second bottom locking flap.

9. The container clip and at least one container of claim 8, wherein the top panel at least partially overlaps each of the first top locking flap and the second top locking flap, and each of the first bottom locking flap and the second bottom locking flap at least partially overlaps the bottom panel.

10. The container clip and at least one container of claim 7, wherein the first side panel is foldably connected to at least one of the top panel and the bottom panel, the first side panel being for extending at least partially between the first container and the second container.

11. The container clip and at least one container of claim 1, wherein:

the at least one container comprises a first container and a second container, the interior of the container clip being for receiving at least a portion of each of the first container and the second container;

the at least one bottom locking flap comprises a first bottom locking flap and a second bottom locking flap; and the first bottom locking flap is for engaging the bottom rim of the first container, and the second bottom locking flap is for engaging the bottom rim of the second container.

12. The container clip and at least one container of claim 1, wherein the first side panel comprises a first free edge and a second free edge, and the side width extends from the first free edge to the second free edge.

13. The container clip and at least one container of claim 12, wherein each of the first free edge and the second free edge of the first side panel is oblique so that at least a portion of the first side panel is tapered.

14. The container clip and at least one container of claim 13, wherein a top bevel panel is foldably connected to the top panel and to the first side panel, the top bevel panel comprises a third free edge and a fourth free edge, and the third free edge and the fourth free edge are oblique so that the top bevel panel is tapered from the top panel to the first side panel.

15. The container clip and at least one container of claim 14, wherein the plurality of panels further comprises a bottom bevel panel foldably connected to the first side panel and the bottom panel, the bottom bevel panel comprises a fifth free edge and a sixth free edge, and the fifth free edge and the sixth free edge are oblique so that the bottom bevel panel is tapered from the bottom panel to the first side panel.

16. A container assembly comprising:

at least a first container, a second container, and a third container, the first container comprising a first rim, the second container comprising a second rim, and the third container comprising a third rim;

a first container clip engaging the first container and the second container, the first container clip comprising a first top panel, a first bottom panel disposed generally opposite the first top panel, a first side panel extending at least partially between the first top panel and the first bottom panel, a first locking flap, and a second locking flap, each of the first locking flap and the second locking flap being foldably connected to one of the first top panel and the first bottom panel;

a second container clip engaging the second container and the third container, the second container clip comprising a second top panel, a second bottom panel disposed generally opposite the second top panel, a second side panel extending at least partially between the second top panel and the second bottom panel, a third locking flap, and a fourth locking flap, each of the third locking flap and the fourth locking flap being foldably connected to one of the second top panel and the second bottom panel; and the first top panel being spaced apart from the second top panel;

wherein the first locking flap engages the first rim of the first container, each of the second locking flap and the third locking flap engages the second rim of the second container, the fourth locking flap engages the third rim of the third container, and the second locking flap and the third locking flap are slidable along the second rim for moving a portion of the first top panel and a portion of the second top panel at least partially together; and wherein the first top panel has a top width extending from the first container to the second container, the first bottom panel has a bottom width extending from the first container to the second container, the first side panel has a side width extending generally parallel to at least one of the top width and the bottom width, and the side width is less than at least one of the top width and the bottom width.

17. The container assembly of claim 16, wherein each of the first locking flap and the second locking flap comprises a curved edge.

18. The container assembly of claim 17, wherein each of the first rim and the second rim comprises a curved interior surface, the curved edges of the first locking flap and the second locking flap engage the respective curved interior surfaces of the respective first rim and second rim.

19. The container assembly of claim 16, wherein the first side panel is foldably connected to at least one of the first top panel and the first bottom panel and extends at least partially between the first container and the second container.

20. The container assembly of claim 16, wherein the first locking flap is a first top locking flap foldably connected to the first top panel, the second locking flap is a second top locking flap foldably connected to the first top panel generally opposite to the first top locking flap, and the first top panel at least partially overlaps the first top locking flap and the second top locking flap.

21. The container assembly of claim 20, wherein the first container clip further comprises a first bottom locking flap foldably connected to the first bottom panel and a second bottom locking flap foldably connected to the first bottom panel generally opposite to the first bottom locking flap, and the first bottom locking flap and the second bottom locking flap at least partially overlap the first bottom panel.

22. The container assembly of claim 21, wherein:

the first rim is a first top rim of the first container, the second rim is a second top rim of the second container, the first container comprises a first bottom rim, and the second container comprises a second bottom rim; and the first bottom locking flap engages the first bottom rim of the first container, and the second bottom locking flap engages the second bottom rim of the second container.

23. The container assembly of claim 16, further comprising at least a fourth container and a third container clip engaging the third container and the fourth container.

24. The container assembly of claim 16, wherein the first side panel comprises a first free edge and a second free edge, and the side width extends from the first free edge to the second free edge.

25. The container assembly of claim 24, wherein each of the first free edge and the second free edge of the first side panel is oblique so that at least a portion of the first side panel is tapered.

26. The container assembly of claim 25, wherein a top bevel panel is foldably connected to the first top panel and to the first side panel, the top bevel panel comprises a third free edge and a fourth free edge, and the third free edge and the fourth free edge are oblique so that the top bevel panel is tapered from the first top panel to the first side panel.

27. The container assembly of claim 26, wherein the plurality of panels further comprises a bottom bevel panel foldably connected to the first side panel and the first bottom panel, the bottom bevel panel comprises a fifth free edge and a sixth free edge, and the fifth free edge and the sixth free edge are oblique so that the bottom bevel panel is tapered from the first bottom panel to the first side panel.

28. The container assembly of claim 16, wherein the first side panel is spaced apart from the second side panel.

29. A method of forming a container assembly, comprising:

obtaining a first clip blank comprising a first plurality of panels comprising a first top panel, a first bottom panel, and a first side panel extending at least partially between the first top panel and the first bottom panel, the first clip blank further comprising a first top locking flap foldably connected to the first top panel and a first bottom locking flap foldably connected to the first bottom panel, wherein the first top panel has a top width extending away from the first top locking flap, the first bottom panel has a bottom width extending away from the first bottom locking flap, the first side panel has a side width extending generally parallel to at least one of the top width and the bottom width, and the side width is less than at least one of the top width and the bottom width;

forming a first container clip from the first clip blank by folding the first plurality of panels relative to one another to form a first interior of the first container clip, the forming the first container clip comprising disposing the first top panel and the first bottom panel adjacent respective ends of a container having a top rim and a bottom rim;

engaging the first top locking flap with the top rim, and engaging the first bottom locking flap with the bottom rim;

obtaining a second clip blank comprising a second plurality of panels comprising a second top panel, a second bottom panel, and a second side panel extending at least partially between the second top panel and the second bottom panel, the second clip blank further comprising a second top locking flap foldably connected to the second top panel and a second bottom locking flap foldably connected to the second bottom panel;

forming a second container clip from the second clip blank by folding the second plurality of panels relative to one another to form a second interior of the second container clip, the forming the second container clip comprising disposing the second top panel and the second bottom panel adjacent respective ends of at least one container;

engaging the second top locking flap with the top rim and the second bottom locking flap with the bottom rim so that each of the second top panel and the second bottom panel is spaced apart from the respective first top panel and first bottom panel; and moving a portion of the first top panel and the first bottom panel toward a respective portion of the respective second top panel and second bottom panel comprising sliding the first top locking flap and the first bottom locking flap along the respective top rim and bottom rim of the container.

30. The method of claim 29, wherein each of the first top locking flap and the first bottom locking flap comprises a curved edge, the engaging the first top locking flap with the top rim comprises disposing the curved edge of the first top locking flap adjacent the top rim, and the engaging the first bottom locking flap with the bottom rim comprises disposing the curved edge of the first bottom locking flap adjacent the bottom rim.

31. The method of claim 29, wherein the engaging the first top locking flap with the top rim comprises folding the first top locking flap with respect to the first top panel so that the first top panel at least partially overlaps the first top locking flap, and the engaging the first bottom locking flap with the bottom rim comprises folding the first bottom locking flap with respect to the first bottom panel so that the first bottom locking flap at least partially overlaps the first bottom panel.

32. The method of claim 29, wherein the first clip blank further comprises a third top locking flap foldably connected to the first top panel, the container is a first container, the top rim is a first top rim, and the bottom rim is a first bottom rim, the forming the first container clip further comprising disposing the first top panel and the first bottom panel adjacent respective ends of a second container having a second top rim and a second bottom rim, and the method further comprises engaging the third top locking flap with the second top rim of the second container.

33. The method of claim 32, wherein the first clip blank further comprises a third bottom locking flap, and the method further comprises engaging the third bottom locking flap with the second bottom rim of the second container.

34. The method of claim 32, wherein the engaging the first top locking flap with the first top rim and the engaging the third top locking flap with the second top rim comprises folding each of the first top locking flap and the third top locking flap so that the first top panel at least partially overlaps each of the first top locking flap and the third top locking flap.

35. The method of claim 29, wherein the first top panel comprises a first top corner, the first bottom panel comprises a first bottom corner, the second top panel comprises a second top corner, the second bottom panel comprises a second bottom corner, and the moving the portion of the first top panel and the first bottom panel toward a respective portion of the respective second top panel and second bottom panel comprises moving the first top corner and the first bottom corner toward the respective second top corner and second bottom corner.

36. A method of forming a container assembly, comprising:

obtaining a first clip blank comprising a first top panel, a first bottom panel, a first side panel, a first locking flap, and a second locking flap, each of the first locking flap and the second locking flap being foldably connected to one of the first top panel and the first bottom panel;

obtaining a second clip blank comprising a second top panel, a second bottom panel, a second side panel, a third locking flap, and a fourth locking flap, each of the third locking flap and the fourth locking flap being foldably connected to one of the second top panel and the second bottom panel;

obtaining a first container comprising a first rim, a second container comprising a second rim, and a third container comprising a third rim;

at least partially forming a first container clip from the first clip blank, the at least partially forming the first container clip comprising positioning the first top panel to have a top width extending from the first container to the second container, positioning the first bottom panel to have a bottom width extending from the first container to the second container, and positioning the first side panel to extend at least partially between the first top panel and the first bottom panel and to have a side width extending generally parallel to at least one of the top width and the bottom width, wherein the side width is less than at least one of the top width and the bottom width;

engaging the first container clip with the first container and the second container, the engaging the first container clip comprising engaging the first locking flap with the first rim of the first container and engaging the second locking flap with the second rim of the second container;

at least partially forming a second container clip from the second clip blank, the at least partially forming the second container clip comprising positioning the second side panel to extend at least partially between the second top panel and the second bottom panel; and engaging the second container clip with the second container and the third container, the engaging the second container clip comprising engaging the third locking flap with the second rim of the second container, engaging the fourth locking flap with the third rim of the third container, and positioning the second top panel to be spaced apart from the first top panel;

wherein the second locking flap and the third locking flap are slidable along the second rim for moving a portion of the first top panel and a portion of the second top panel at least partially together.

37. The method of claim 36, wherein:

each of the first locking flap and the second locking flap comprises a curved edge;

each of the first rim of the first container and the second rim of the second container comprises a curved interior surface;

the engaging the first locking flap with the first rim comprises disposing the curved edge of the first locking flap adjacent the curved interior surface of the first rim; and the engaging the second locking flap with the second rim comprises disposing the curved edge of the second locking flap adjacent the curved interior surface of the second rim.

38. The method of claim 36, wherein the first locking flap is a first top locking flap foldably connected to the first top panel, the second locking flap is a second top locking flap foldably connected to the first top panel generally opposite to the first top locking flap, and each of the engaging the first locking flap with the first rim and the engaging the second locking flap with the second rim comprises folding each of the first top locking flap and the second top locking flap with respect to the first top panel so that the first top panel at least partially overlaps the first top locking flap and the second top locking flap.

39. The method of claim 38, wherein the first container clip further comprises a first bottom locking flap foldably connected to the first bottom panel and a second bottom locking flap foldably connected to the first bottom panel generally opposite to the first bottom locking flap, and the engaging the first container clip with the first container and the second container further comprises folding each of the first bottom locking flap and the second bottom locking flap with respect to the first bottom panel so that each of the first bottom locking flap and the second bottom locking flap at least partially overlap the first bottom panel.

40. The method of claim 36, wherein the first top panel comprises a first corner and the second top panel comprises a second corner, and the second locking flap and the third locking flap are slidable along the second rim for moving the first corner of the first top panel and the second corner of the second top panel at least partially together.

* * * * *